United States Patent [19]

Denman

[11] Patent Number: 4,831,666

[45] Date of Patent: May 23, 1989

[54] GARMENT ESPECIALLY ADAPTED FOR PROTECTING THE KNEES WHILE GARDENING

[76] Inventor: Robert Z. Denman, 4782 Sanbert St., Placentia, Calif. 92670

[21] Appl. No.: 109,221

[22] Filed: Oct. 15, 1987

[51] Int. Cl.[4] ..... A41D 13/06

[52] U.S. Cl. ..... 2/23; 2/24

[58] Field of Search ..... 2/23, 24

[56] References Cited

U.S. PATENT DOCUMENTS

| | | | |
|---|---|---|---|
| 671,059 | 4/1901 | Sanders | 2/23 |
| 907,050 | 12/1908 | Hestness | 2/23 |
| 2,355,193 | 8/1944 | Walker | 2/23 X |
| 4,561,124 | 12/1985 | Thompson | 2/23 |
| 4,613,991 | 9/1986 | Grover | 2/23 |

*Primary Examiner*—Louis K. Rimrodt

*Attorney, Agent, or Firm*—Klein & Szekeres

[57] ABSTRACT

A garment or pant specifically adapted for providing protection to a person's knees in kneeling position while performing gardening or like chores, is disclosed. The garment has a pair of legs, and a pocket affixed to the exterior of each leg. A padded cushioning member is substantially fixedly held in each pocket. The pockets are affixed to the legs in such positions that the pockets and the cushioning member register in the appropriate positions to provide a cushioning and insulating barrier between the wearer's knees and the ground when the wearer is in kneeling position.

17 Claims, 2 Drawing Sheets

FIG. 4
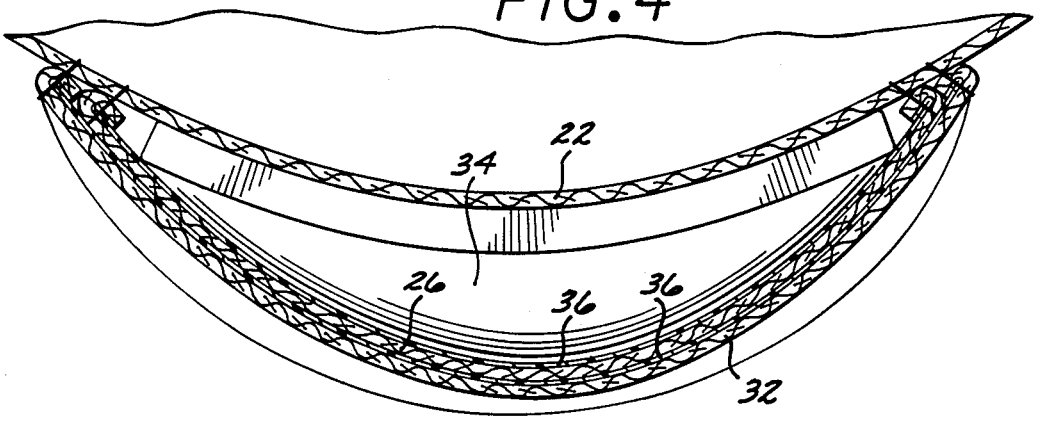
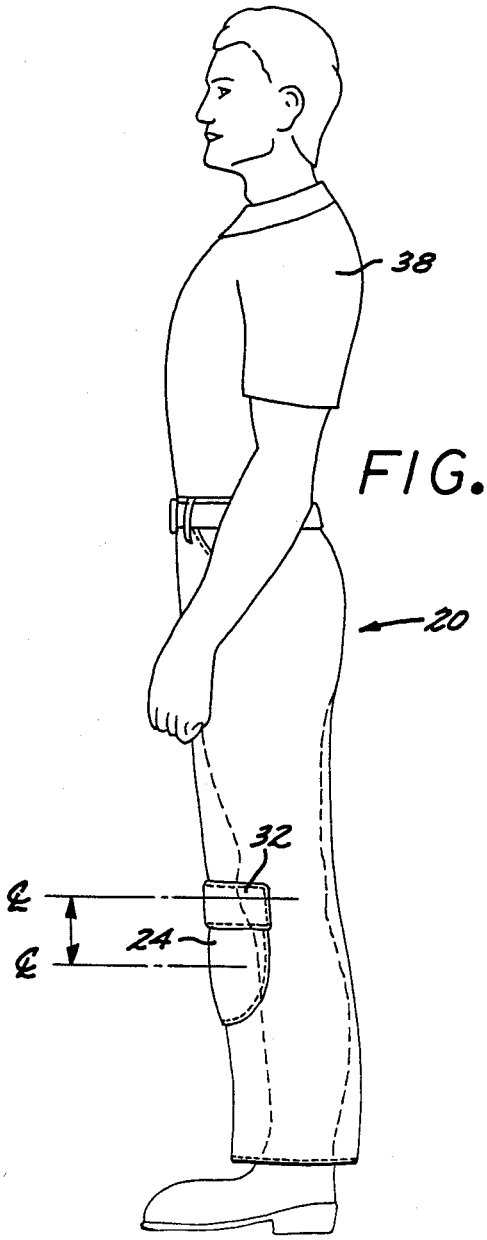
FIG. 5
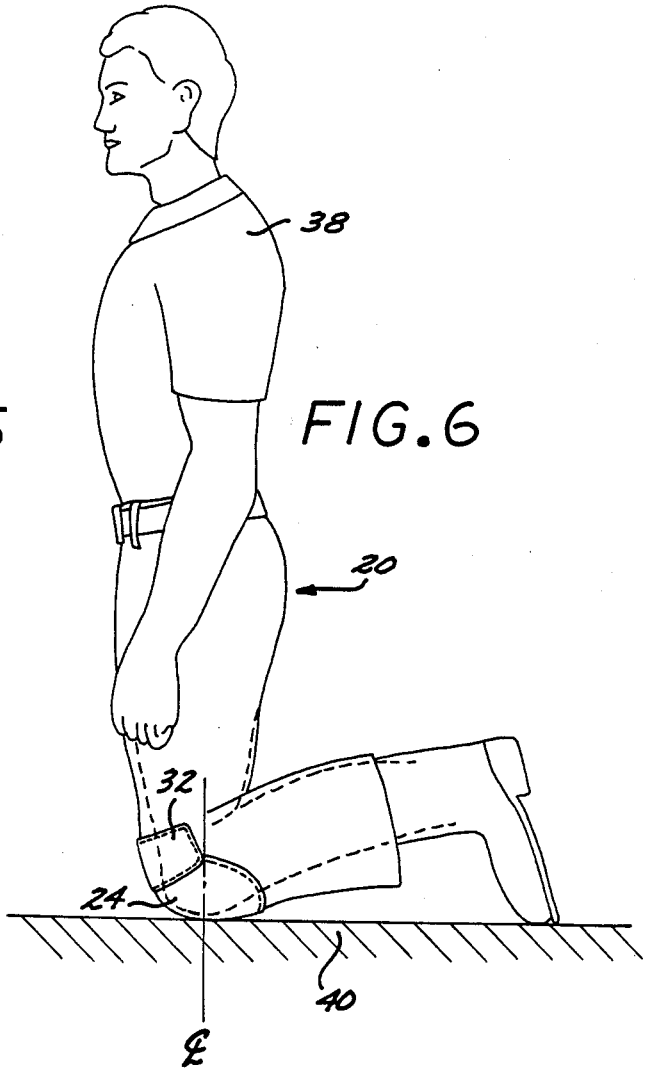
FIG. 6

GARMENT ESPECIALLY ADAPTED FOR PROTECTING THE KNEES WHILE GARDENING

BACKGROUND OF THE INVENTION

1. Field of Invention The present invention is directed to improvements in garments. More particularly, the present invention is directed to a pant specifically adapted for protecting the knees while gardening or performing other chores which require a person to kneel on the ground or like flat 2. Brief Description of the Prior Art Gardening pants have been used in the prior art for a long time. However, as far as the present inventor is aware, gardening pants of the prior art had no means or feature for protecting the knees of the wearer while the wearer kneels on one or both knees, even though gardening, such as digging small holes in the ground, planting, and the like often requires such kneeling positions.

As far as the present inventor is aware, knee protectors in garments have been used in the prior art primarily in connection with the sports of football and motocross motorcycle racing. In "football pants" the knee protector comprises a padded cushioning member placed into a pocket which is within the interior of the leg of the pant. The pocket is affixed to the leg in such a manner that the cushioning member is directly in front of the wearer's knees while the wearer is standing, walking or running. Such "football pants," however, are not suitable for use as gardening pants, and the protective cushions or pads of the football pants are not appropriately disposed for cushioning the knees when the wearer kneels on the ground.

In light of the foregoing, there is a need in the prior art for garments or pants specifically adapted for protecting or cushioning the knees while the wearer is in kneeling position. The present invention provides such a protective garment.

SUMMARY OF THE INVENTION

It is the object of the present invention to provide a pant or garment which is specifically adapted for cushioning the knees of its wearer, while the wearer is in a kneeling position.

It is another object of the present invention to provide a protective garment for the knees while gardening, which garment can be manufactured relatively economically.

The foregoing and other objects and advantages are attained by a garment or pant having a pair of legs, and a pocket affixed to the exterior of each leg. A padded cushioning member is substantially fixedly held in each pocket, to provide a cushioning and insulating barrier between the wearer's knees and the ground when the wearer is in kneeling position. It is well known that when a person kneels, the legs of the person's pants are normally pulled upward relative to the position of the pants in normal standing or walking posture of the person. In accordance with the invention, the pockets are affixed to the legs in such positions that the pockets and the cushioning member register in appropriate positions on the knees to provide the above noted cushioning effect when the wearer kneels.

The features of the present invention can be best understood together with further objects and advantages by reference to the following description, taken in connection with the accompanying drawings.

BRIEF DESCRIPTION OF THE DRAWINGS

FIG. 4 is another enlarged cross-sectional view of the pocket section of the protective garment of the present 4 invention, the cross-section being taken on lines 4, 4 of FIG. 1;

FIG. 5 shows a person wearing the garment of the present invention in standing position; and FIG. 6 shows a person wearing the garment of the present invention in a kneeling position.

DESCRIPTION OF THE PREFERRED EMBODIMENT

Figure 1:
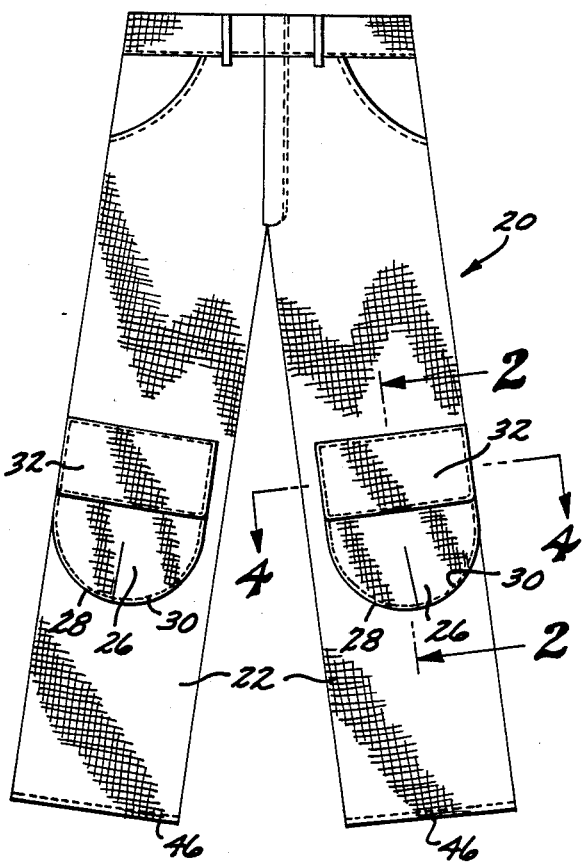
FIG. 1 is a front plant view of a preferred embodiment of the protective garment of the present invention.

The following specification taken in conjunction with he drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing figures, a preferred embodiment of the protective garment 20 of the present invention is disclosed. The protective garment 20 of the invention is particularly adapted for protecting the knees of a person while in kneeling position. Therefore, the protective garment 20 of the present invention is particularly adapted to be worn by persons while performing gardening chores, such as kneeling on the ground while digging small holes for planting, or the like.

The protective garment 20, which hereinafter is also referred to as a "gardening pant," includes a substantially conventional pair of pants having a pair of legs 22. As a unique feature of the pants 20, a pocket 24 is sewn to the front of each leg 22 on the exterior of the fabric which comprises the leg 22. The pocket 24 includes a lower flap 26 of fabric which has a substantially semicircular lower edge or border 28 sewn to the leg 22 with a matching, substantially semicircular seam 30.

Figure 3:
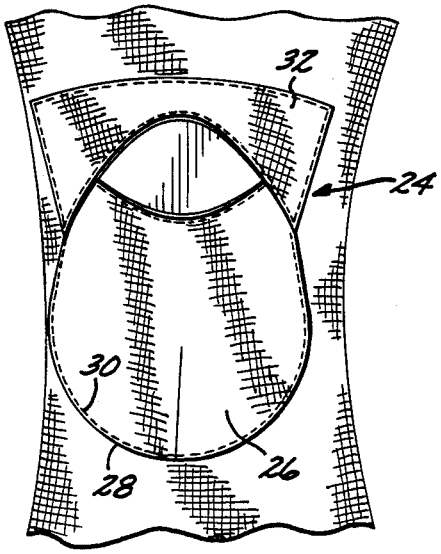
FIG. 3 is an enlarged front plan view of the pocket section of the protective garment of the present invention, the view showing the pocket opened for insertion of a cushioning member or pad.

Another, upper flap of fabric 32 is substantially rectangular, and is sewn to the leg 22 in a position wherein it only partially overlaps the lower flap 26. Thus, when the lower 26 and upper 32 flaps are pulled apart, as is shown schematically on FIG. 3, a protective pad 34 can be inserted into the pocket 24.

The pant 20 itself may be made from several types of fabrics normally used in the garment industry for purposes of making outdoor style, or work clothing. The flaps 26 and 32 of the fabric which form the pockets 24 are preferably, out not necessarily, made from the same fabric as the pant 20. In the herein described preferred embodiment, the of the pant 20 is cotton twill, although denim, and still other fabrics are also quite suitable for this purpose.

The flaps of fabric 26 and 32 which comprise the pockets 24, also include an interior lining 36 of plasticized fabric. In the preferred embodiment, the interior lining 36 is nylon cordura. The primary purpose of the interior lining 36 of plasticized fabric is to function as a moisture barrier. This is useful when a person wearing the protective gardening pant 20 kneels on moist ground. A person 38 wearing the gardening pant 20 of the present invention is shown on FIGS. 5 and 6 and the ground surface 40 is schematically shown on FIG. 6.

Figure 2:
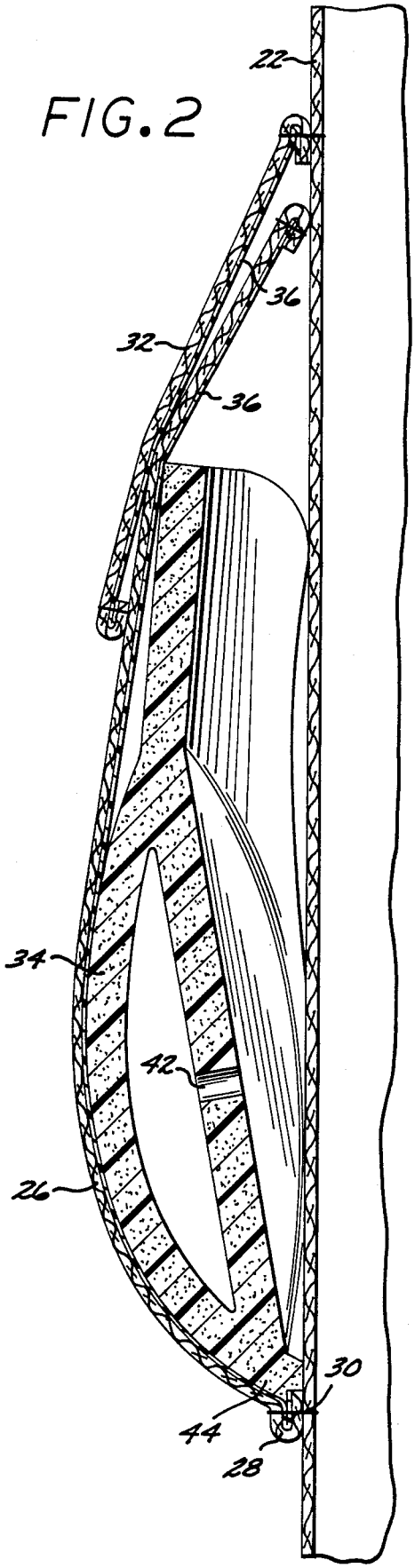
FIG. 2 is an enlarged cross-sectional view of the pocket section of the protective garment of the present invention, the cross-section being taken on lines 2, 2 of FIG. 1.

The protective pad 34 utilized in the herein described preferred embodiment comprises extruded foam rubber and is hollow inside. This is best shown on FIGS. 2 and 4. It should be apparent from the foregoing and from an inspection of FIG. 4, that when the person 38 wearing the gardening pant 20 kneels down, a vent hole 42 in the hollow pad 34 is more or less blocked, so that air is at least momentarily trapped within the hollow interior thereby providing an extra cushioning effect to the protective pad 34.

The configuration of the protective pad 34 is such that it fits relatively tightly in the pockets 24. More particularly, the semicircular seam 30 of the lower flap 26, semicircular lower edge 44 of the protective pad 34, and the upper flap 32 cooperate to keep the pad 34 aligned in the pocket 24.

The positioning of the pockets 24, and therefore of the pads 34 comprises an important feature of the present invention. In this regard, it is noted that unlike in protective pants (not shown) used by football players (not shown,) the pockets 24 are disposed low, slightly below the knees of the wearer 38. This positioning of the pockets 24 causes them to be "pulled up" and be placed in the proper position between the knees and the ground 40 when the wearer 30 kneels for gardening, or to perform other chores.

The following Table illustrates the positioning of the pockets in "extra small," "small," "medium," "large" and "extra large" pants, respectively. The Table indicates (in inches) the distance between the bottom hem 46 of the leg 22 of the pant and the bottom of the pocket 24, and also the distance between the bottom hem 46 of the leg 22 and the top of the pocket 24.

TABLE

| Pant Size | Distance between bottom hem and bottom of pocket | Distance between bottom hem and top of pocket |
|---|---|---|
| Extra Small | 12" | 20" |
| Small | 12.5" | 20.5" |
| Medium | 13" | 21" |
| Large | 13.5" | 21.5" |
| Extra Large | 14" | 22" |

Those skilled in the art will readily recognize that the foregoing dimensions represent "low riding" pockets for the protective garments 20. This "low riding" positioning of the pockets 24 is unique and renders it possible for the pads 34 to function as knee protectors when the wearer is in kneeling position.

Moreover, as is shown on the drawing figures, the bockets 24 are disposed off center to the outside. In other words, (as shown in the drawings) each pocket 24 is sewn into the respective leg 22 substantially flush with the edge of the fabric leg 22. This positioning of the pockets 24 also, helps to place the protective pads 34 between the knees and the ground 40 when the wearer 38 is kneeling. Several modification of the present invention may become readily apparent to those skilled in the art in light of the foregoing disclosure. Therefore, the scope of the present invention should be interpreted solely from the following claims, as such claims are read in light of the disclosure.

What is claimed is:

1. A garment especially adapted for cushioning the knees of a person while the person is in kneeling position, the garment comprising:

a pair of pats having a pair of legs and a pocket affixed to the exterior of each leg, and a cushioning member contained in each pocket, the cushioning member forming a padding between the knees of the person using the pants and the ground when said person is in a kneeling position, the cushioning members and the pockets being configured such that each pocket cooperates with one pad to hold the pad in a fixed position in the pocket, each of the pockets being disposed on the exterior of each leg asymmetrically off center to the outside relative to the center line of the respective leg of the pant, and in appropriate positions for the cushioning member to be pulled up when the person wearing the garment kneels and then to be disposed between the knees and the ground in said kneeling position of the person.

2. The protective garment of claim 1 wherein each pocket comprises a lower flap of fabric affixed to the leg of the pant, and an upper flap of fabric affixed to the leg of the pant, an opening being formed between the upper and lower flaps wherein the cushioning member is inserted into the pocket.

3. The protective garment of claim 2 wherein the lower edge of the lower flap is substantially circular and is affixed to the pant to form a substantially semicircular seam and wherein the lower edge of the cushioning member substantially conforms to the semicircular configuration of the seam.

4. The protective garment of claim 1 wherein the cushioning member comprises extruded foam rubber.

5. The protective garment of claim 1 wherein the pockets are lined with plasticized fabric.

6. The protective garment of claim 1 wherein the pants comprise fabric selected from the group consisting of cotton twill and denim.

7. A gardening pant especially adapted for protecting knees of a person while said person kneels on one or two knees, the gardening pant comprising, in combination:

a pant having a pair of legs;

pocket means affixed to the exterior of each leg off center from the longitudinal center line of each leg and substantially flush with the exterior seam of the leg, for substantially fixedly holding a padded cushioning member on each leg in a position between the knee of the person wearing the pants and the ground when said person is in a kneeling position, the pocket means holding each padded cushioning member below the knee during normal wear of the pant relative to which the cushioning member is pulled up when the person kneels, and a pair of padded cushioning members, each of which is contained in substantially fixed position in one of the pocket means.

8. The gardening pant of claim 7 wherein the pocket means comprises a lower fabric flap affixed by a seam to the leg, and an upper fabric flap affixed by a seam to the leg, the upper and lower fabric flaps partially overlapping with one another.

9. The gardening pant of claim 8 wherein the lower border of the lower fabric flap is configured substantially as a semicircle, the seam affixing the lower border to the leg is configured substantially as a semicircle and wherein the lower border of the padded cushioning member is configured substantially as a semicircle to conform substantially to the seam affixing the lower border, whereby the padded cushioning member is held substantially motion free within the pocket means.

10. The gardening pant of claim 9 wherein the padded cushioning member comprises extruded foam rubber.

11. The gardening pant of claim 10 wherein the insides of the upper and lower pad members are lined with a plasticized fabric.

12. In a gardening pant of the type worn by persons performing gardening chores, and having a pair of legs, the improvement comprising:

pockets attached to each of the legs on the exterior of the legs off center toward the exterior relatively to the longitudinal center line of the leg and comprising means for holding the cushioning members in substantially fixed positions relative to the pockets;

a pair of cushioning members, each of the cushioning members being held substantially fixedly in one of the pockets, the pockets being disposed in such position on the legs that the cushioning member is pulled upwardly relative to its normal position during regular wear, and in its pulled-up position is disposed between the knee and the ground when the person wearing the pant kneels on the ground.

13. The improvement of claim 15 wherein each pocket comprises a lower fabric flap affixed by a seam to the exterior of the leg, the seam having a lower substantially semicircular portion, and an upper fabric flap affixed by a seam to the exterior of the leg, the upper and lower flaps overlapping in part.

14. The improvement of claim 13 wherein the flaps of each pocket contain an interior lining comprising a barrier for penetration of moisture.

15. The improvement of claim 14 wherein the interior lining is a plasticized fabric.

16. The improvement of claim 14 wherein the pant comprises cotton twill fabric.

17. The improvement of claim 16 wherein each cushioning member comprises extruded form rubber.

* * * * *